United States Patent [19]

Berend et al.

[11] Patent Number: 4,636,605

[45] Date of Patent: Jan. 13, 1987

[54] MODE STIRRING TURNTABLE FOR MICROWAVE OVEN

[75] Inventors: Peter M. Berend; Richard D. Dilyard; William A. Pesa; Howard J. Vaeth, all of Wooster, Ohio

[73] Assignee: Rubbermaid Incorporated, Wooster, Ohio

[21] Appl. No.: 755,761

[22] Filed: Jul. 17, 1985

[51] Int. Cl.[4] ..... H05B 6/74; A47B 85/00

[52] U.S. Cl. ..... 219/10.55 F; 219/10.55 E; 108/20; 126/338; 99/443 R; 99/DIG. 14

[58] Field of Search ..... 219/10.55 F, 10.55 E, 219/10.55 R; 108/20, 139; 126/338; 99/DIG. 14, 451, 443 R

[56] References Cited

U.S. PATENT DOCUMENTS

| | | | |
|---|---|---|---|
| 4,121,078 | 10/1978 | Takano et al. | 219/10.55 F |
| 4,216,727 | 8/1980 | Cunningham | 108/20 |
| 4,239,009 | 12/1980 | Cunningham | 108/20 |
| 4,254,319 | 3/1981 | Beh et al. | 219/10.55 F |
| 4,258,630 | 3/1981 | Jorgensen | 108/20 |
| 4,330,696 | 5/1982 | Pomeroy et al. | 219/10.55 F |
| 4,330,697 | 5/1982 | Danley et al. | 219/10.55 F |
| 4,424,431 | 1/1984 | Gurubatham | 219/10.55 F |
| 4,453,064 | 6/1984 | Toyoda et al. | 219/10.55 F |
| 4,456,805 | 6/1984 | Jorgensen | 219/10.55 F |
| 4,501,945 | 2/1985 | Arabori et al. | 219/10.55 F |
| 4,504,715 | 3/1985 | Jorgensen | 219/10.55 F |
| 4,523,070 | 6/1985 | Jorgensen | 219/10.55 F |

FOREIGN PATENT DOCUMENTS

| | | | |
|---|---|---|---|
| 1066679 | 10/1959 | Fed. Rep. of Germany | 219/10.55 F |

*Primary Examiner*—Philip H. Leung

*Attorney, Agent, or Firm*—Richard B. O'Planick

[57] ABSTRACT

A turntable for microwave oven is disclosed, comprising a base (4), having a platform (2) rotatively mounted thereto. A motor assembly (6) is mounted to an underside of the platform (2) and engages with a gear ring (28) in the base (4), whereby turning the platform (2). The motor assembly (6) has a metallic casing (126, 128) and serves as a secondary mode stirrer. A speed reduction assembly (8) is further provided, mounted to the underside of the platform (2).

28 Claims, 7 Drawing Figures

MODE STIRRING TURNTABLE FOR MICROWAVE OVEN

BACKGROUND OF THE INVENTION

1. Field of the Invention

The subject invention pertains to portable turntables, in general, and specifically to turntables for use in microwave ovens.

2. The Prior Art

Conventional microwave ovens typically include a high frequency wave generator which sources microwave energy to the interior of a heating cavity. Food placed within the cavity and subjected to the microwave energy is thereby cooked. One problem, however, encountered in cooking food in a microwave oven is that the microwave energy is not dispersed uniformly within the heating cavity. The standing microwave pattern creates cold spots which cause the food to heat unevenly.

The industry, in response to the problem, have taken two main approaches toward a solution. The first is to improve the microwave energy source, through mode stirring or the like, so as to more evenly distribute energy within the oven cavity. Such attempts have to date not been entirely successful.

The second approach taken by the industry has been to develop rotatable turntables for use within the oven cavity. The turntable supports and moves food in a circular path to compensate for the effect of standing wave cold spots.

U.S. Pat. No. 4,504,715 teaches a turntable for use in microwave ovens comprising a turntable platform which is mounted to a stationary base. A motor, fixedly mounted on the center axis of the turntable, encased within a metallic pan drives a center shaft to thereby rotate the platform.

U.S. Pat. No. 4,330,696 discloses an alternatively configured turntable having a motor fixedly positionable adjacent to the turntable platform. The motor rotatably drives against an outwardly accessible gear ring which circumferentiates the turntable platform.

While the above available turntables function well and have been favorably received in the market, certain deficiencies prevent them from representing a complete solution to the industry's needs. First, the available turntables are relatively complex, making them difficult to assemble and expensive to manufacture. Further, such existing turntables are relatively large and can be difficult to fit into smaller ovens. Situating the motor outside of the turntable circumference as taught by U.S. Pat. No. 4,330,696 makes the turntable less space efficient. Finally, existing turntables only serve to minimize the effect of cold spots in the microwave oven cavity and do not address the cause of the problem.

SUMMARY OF THE PRESENT INVENTION

The present invention relates to a turntable for a microwave oven of the general type discussed above. The turntable comprises a base, a platform rotatively mounted thereto, and a motor assembly for rotating the platform about a vertical central axis. The motor assembly is mounted to an underside of the rotating platform and depends into the central cavity of the base unit. A peripheral inwardly directed gear ring is formed within the base of the turntable. The motor provides an outward directed drive gear which meshes with the base gear ring. In the operative mode, the motor migrates about the gear ring, unitarily rotating with the turntable.

So located, the drive motor is contained entirely within the circumference of the base unit which results in an overall compact turntable configuration.

A further aspect of the present invention is that the motor is housed within a metallic outer shell. Migration of the motor during operation of the turntable thereby functions as a secondary mode stirrer. The metallic casing of the motor reflects microwave radiation and disrupts the standing wave pattern within the microwave cavity. A dispersed, and hence more uniform, distribution of microwave energy results in an even heating of the food in the oven. Speed reduction means is further disclosed mounted to the underside of the rotating turntable in diametric opposition to the motor assembly. The speed reduction assembly functions to regulate the speed at which the turntable turns.

Accordingly, it is an objective of the present invention to provide a turntable for microwave oven having an overall compact profile.

A further objective is to provide a turntable having mode stirring means.

Yet a further objective of the present invention is to provide a turntable having a relatively small number of component parts.

Still a further objective of the present invention is to provide a turntable having a shielded motor assembly.

Yet a further objective is to provide a turntable having a motor assembly situated within the confines of the base circumference.

A further objective is to provide a turntable which is economically and readily produced, and which is easily assembled.

These and other objectives, which will be apparent to those skilled in the art, are achieved by a preferred embodiment which is described in detail below, and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
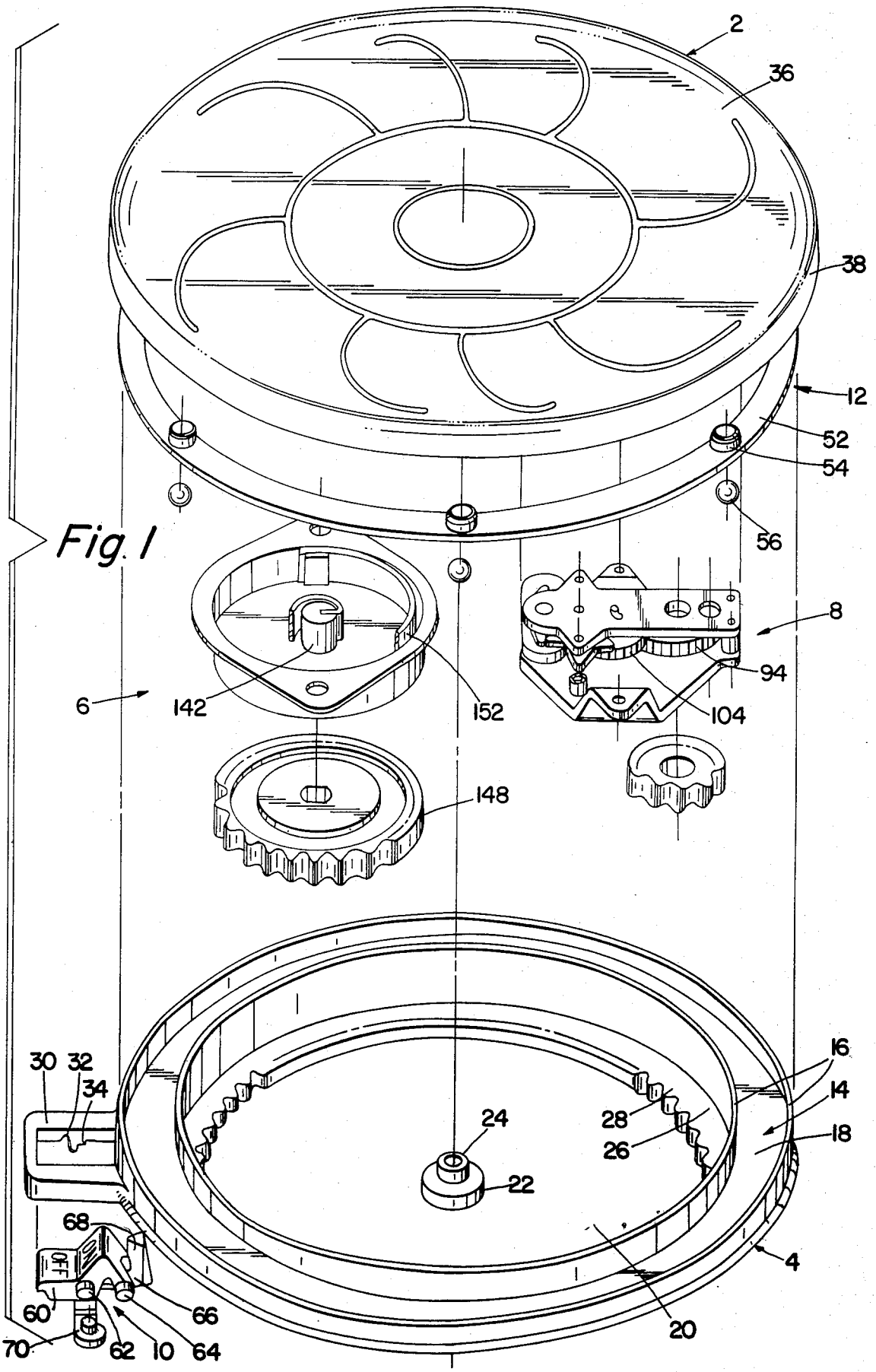
FIG. 1 is an exploded perspective view of the subject turntable illustrating the gear reducer and motor in assembled condition.

Referring first to FIG. 1, the subject turntable is illustrated in exploded perspective view as comprising the following: a rotatable disc-shaped platform 2; a stationary base component 4; a motor assembly 6; a speed reduction assembly 8; and a switch assembly 10. Platform 2 and stationary base 4 are formed of suitable dielectric plastics material; for example, glass-filled polyester. The platform and base further are dimensioned to fit conveniently within the cooking cavity of a microwave oven. A suitable dimension for the base would be 9.0 inches or 22.86 centimeters in diameter.

As shown, the rotatable platform 2 is intended for concentric mounting over the stationary base unit 4 and rotates thereupon. A bearing retaining ring assembly 12 is provided which is adapted to fit within a circumferential annular channel 14 formed within the base unit 4. The channel 14 is defined by vertical side walls 16 which extend in parallel about the circumference of the base unit 4 and which are seperated by a bottom channel surface 18. Base unit 4 is further configured to provide a centrally located boss 22, positioned upon a bottom base surface 20 and having an axial hole 24 formed therethrough. The boss 22 represents the vertical axis of rotation for the rotatable platform 2.

A horizontal annular ledge 26 is situated to the interior of the annular channel 14. A concentric ring of gear teeth 28 is formed within the ledge 26 directed toward the central boss 22, proximate to the bottom base surface 20. The gear ring 28 thus is formed to extend concentrically about the center boss 22, generally adjacent to the bottom surface 20 of the base.

A rectangular switch mounting bracket 30 is provided as an integral side extension to the base unit 4. The rectangular bracket 30 has a pivot detent 32 formed within an underside thereof contiguous to a serpentine locking detent 34. The mounting bracket 30 is adapted for supporting the switch assembly 10 in a manner described in further detail below.

Figure 5:
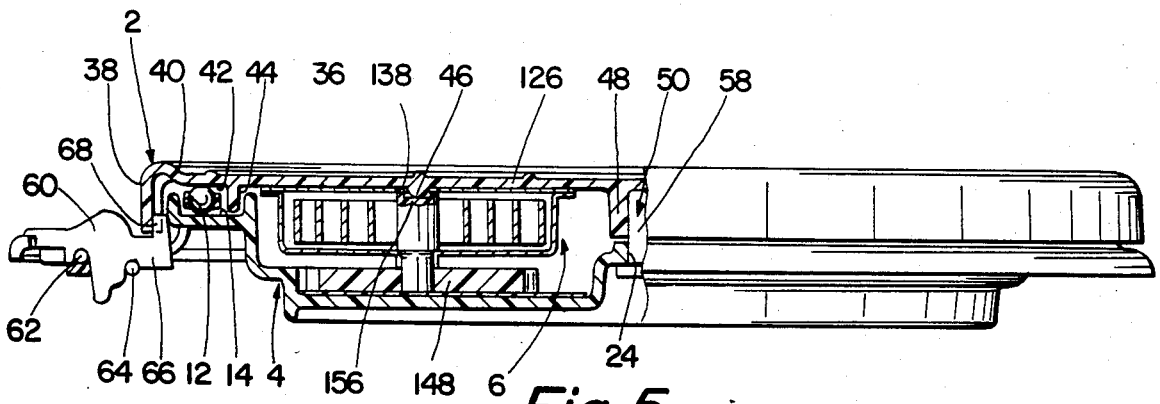
FIG. 5 is a cross-section taken along the line 5—5 of FIG. 4.

With continued reference to FIGS. 1 and 5, the rotatable platform 2 is generally configured to provide a planar top surface 36 for supporting cookware in a microwave oven. A dependent rim 38 extends the periphery of surface 36. An annular gear ring 40 is situated concentrically within the dependent rim 38 to face inwardly toward the central vertical axis of rotation. A circumferential channel 42 is formed to extend the perimeter of an under side surface of the rotatable platform 2, defined by the dependent rim flange 38 and an annular internal flange 44. The channel 42 is situated and dimensioned to fit over the afore-described complimentary channel 14 of the base 4. A downward directed motor assembly locating post 46 is formed to the underside surface of the turntable platform 2 offset from the rotation axis. A centrally located sleeve 48 is adapted to project downward from the underside of platform 2 and provides a central axially bore 50 for assembly purposes.

With continued reference to FIGS. 1 and 5, the bearing retainer ring assembly 12 is shown to comprise a retainer ring 52 formed of a suitable plastics material such as polycarbonate. Situated at regularly spaced intervals about the retainer ring 52 are retention collars 54 which are sized to retain spherical bearings 56. The bearings 56 are preferably composed of steel or glass and have a diameter of approximately 0.25 inches or 0.635 centimeters. The bearing retainer ring 12 resides within the base channel 14 and is encapsulated by the sidewall 44 and the outwardmost vertical sidewal 16 of the base 4. It will be appreciated that the spherical bearings 56 of the bearing retaining ring assembly 12 support the rotatable platform 2 so that the platform is free to rotate thereupon about the central vertical axis of the turntable. A center pin 58 is inserted upwardly through the boss axial hole 24 of the base 4, and into the centering sleeve 48 of the turntable platform 2. The centering pin 56 thus assembles the base and the platform components together while permitting free rotation of the turntable platform about the central vertical axis of the base.

With continued references to FIGS. 1 and 5, the switch assembly 10 essentially comprises a rocker body 60 having a generally W-shaped profile. The rocker body 60 is intended to mount within the rectangular switch mounting bracket 30 of the turntable base 4. The rocker body 60 has outwardly projecting pivot pins 62 extending from opposite sides to reside within the pivot detent 32 of the mounting bracket 30. The switch rocker body 60 further has two detent pins 64 extending from opposite sides proximate to the forward end of the rocker body. So located, the rocker body is free to pivot forward and backward about pivot pins 62. Pivoting movement of the rocker body 60 causes detent pins 64 to ride over the serpentine profile of the locking detents 34 into "on" and "off" recessed portions of the detents 34. Projecting forward from the rocker body 60 is a reverse L-shaped locking finger 66. The locking finger 66 extends horizontally forward to a remote vertical finger segment 68'. The vertical segment 68' of the locking finger 66 is wedge-shaped in section, pointing toward the rocker body 60.

A rectangular locking plate 70 is provided having an upwardly projecting assembly post 72 at opposite ends. It will be apparent that the locking plate 70 entraps the rocker body 60 against the mounting bracket 30 as posts 72 are press fit and adhered into corresponding apertures within an under surface of the mounting bracket 30 (not shown).

FIG. 5 illustrates the switch in the assembled "off" condition. The forward extending finger 66 projects under the downward rim flange 38 of the turntable platform 2. Pivoting actuation of the rocker body 60 causes the locking finger portion 68 to pivot toward and away from the peripheral gear ring 40 formed integrally within the dependent rim flange 38. As the locking finger portion 68 is pivoted toward and into engagement with the gear ring 40, rotational motion of the turntable platform 2 is inhibited. Conversely, when the rocker body 60 is pivoted forward into the "on" position, the locking finger portion 68 pivots away from the gear ring 40 and thereby frees the turntable to rotate.

Figure 2:
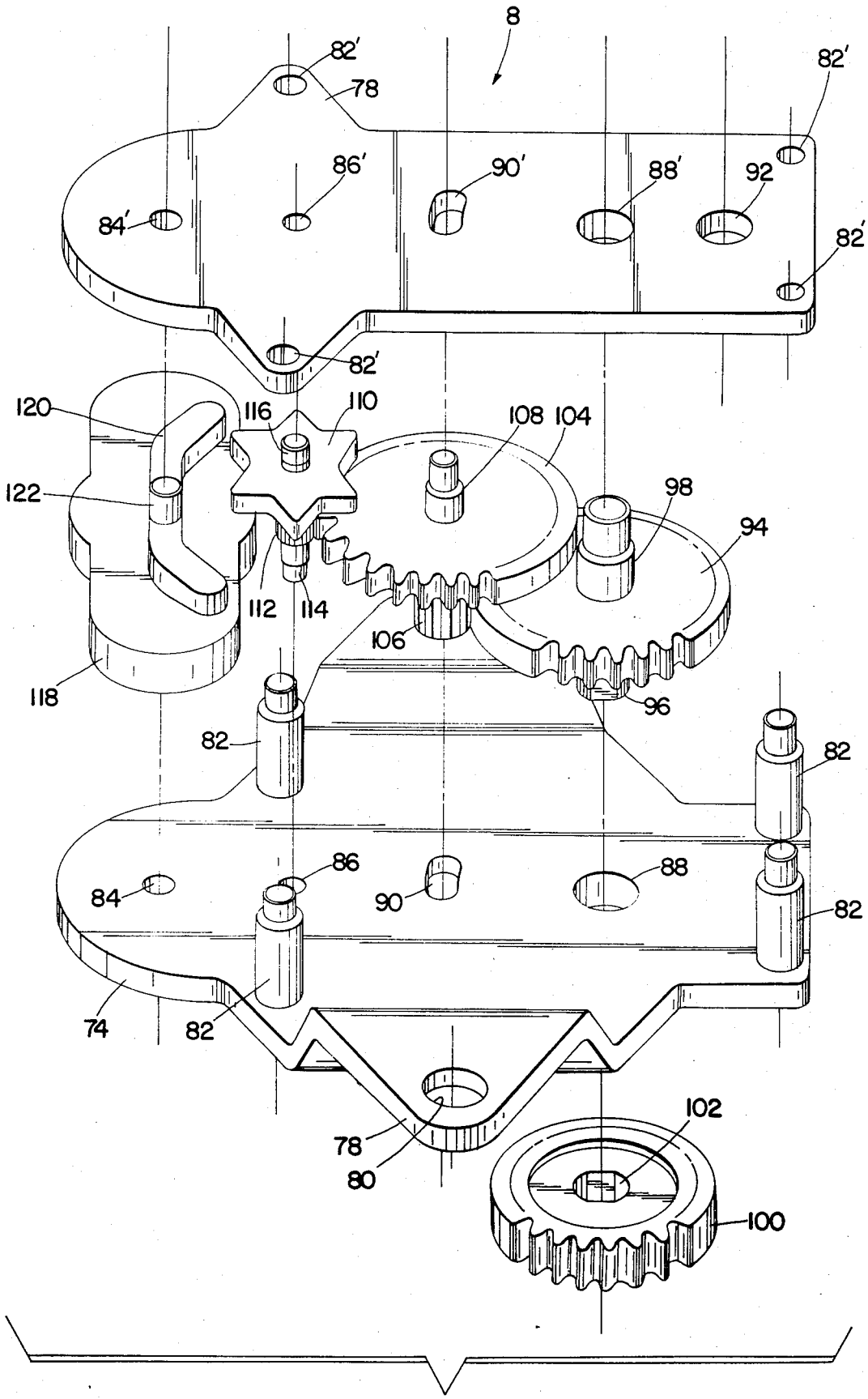
FIG. 2 is an exploded perspective view of the gear reducer assembly.
Figure 6:
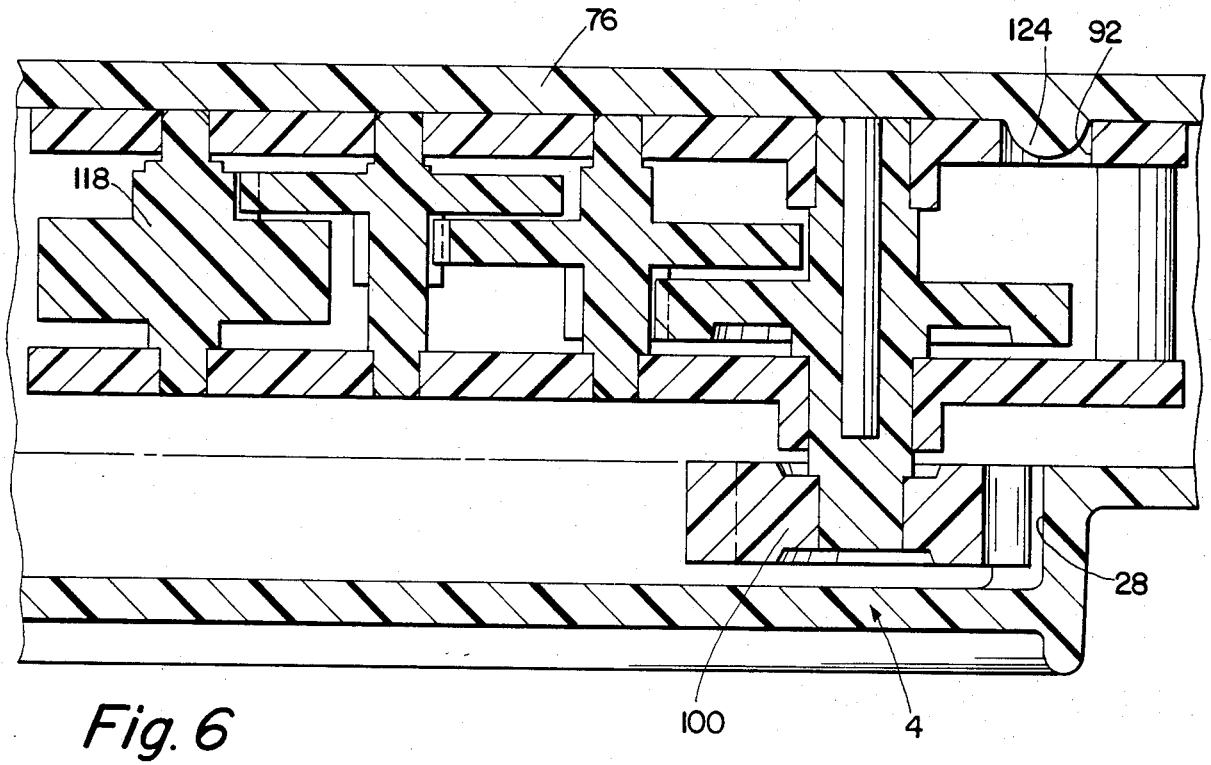
FIG. 6 is a cross-section taken through the line 6—6 of FIG. 4, illustrating the gear reducer in the assembled condition.

Referring next to FIGS. 2 and 6, the speed control assembly 8 is shown to comprise a bottom housing plate 74 and a top housing plate 76 of generally a rectangular configuration, having outward directed mounting flanges 78 projecting from opposite sides. The mounting flanges 78 have a mounting aperture 80 therethrough for assembling the speed reduction assembly 8 to an underside surface of the turntable platform 2 as described in greater detail below. Four assembly posts 82 extend vertically upward from the bottom housing plate 74 and assemble through a corresponding four assembly apertures 82' in the top housing plate 76. Corresponding pairs of assembly apertures 84, 84'; 86, 86'; 88, 88'; and an escapement aperture pair 90, 90' are provided within the bottom and top housing plates 74, 76, respectively. A locating aperture 92 is provided within the top plate 76.

A speed reduction gear train is housed between the top and housing plate 74, 76. The gear train comprises an internal drive gear 94 having a dependent central shaft 96, and an upward directed stepped shaft segment 98. An external drive pinion 100 is coupled to the dependent central shaft 96 of the internal drive gear 94. The external drive pinion 100 accordingly is provided with an axial assembly aperture 102 into which the dependent central shaft 96 is press fit. So assembled, the drive pinion 100 and the drive gear 94 rotate in unison.

An escapement gear 104 meshes with the drive gear 94, at a dependent secondary gear portion 106. An upward stepped shaft segment 108, and a downward directed shaft segment of the dependent secondary gear 106 (not shown) project into the escapement apertures 90, 90', respectively. The escapement apertures 90, 90' are elliptical in shape and permit lateral movement of the escapement gear shaft segments therein. Resultingly, the escapement gear can move laterally within the escapement slots 90, 90' in conventional fashion, whereby moving into and out of engagement with a star gear 110.

The star gear 110 is coupled at a secondary gear portion 112 to the escapement gear 104. A dependent shaft segment 114 and an upward shaft segment 116 project from gear 110 into the assembly apertures 86, 86', respectively. A crescent shaped, horizontal oscillator plate 118 is provided having a top-mounted U-shaped actuator flange 120 situated thereupon to face the star gear 110. The actuator flange 120 is located in engaging proximity to the star gear 110. An upward shaft segment 122 and a dependent shaft segment (not shown) project from the oscillator plate 118 for fit into the assembly apertures 84, 84'.

FIG. 6 illustrates the speed reduction assembly 8 assembled to the underside surface of the turntable platform 2. A downward locating post 124 is provided on the under surface of the platform 2 and registers into the locating aperture 92 within the top housing plate 76. The speed reduction assembly 8 is located off center from the center axis of the turntable and is situated such that the dependent drive pinion 100 is brought into meshing engagement with the annular gear ring 28 of the base 4. Fixedly secured to the underside of the platform 2, the speed reduction assembly 8 rotates unitarily therewith as the drive pinion 100 rotates along gear ring 28, thereby driving the gear train. The resultant oscillation of oscillator 118 dissipates energy and thereby acts to regulate the speed at which the turntable can move. Thus, the speed reduction assembly 8 serves as a speed regulator to limit the revolution of the turntable platform 2 to a prescribed rate.

Figure 7:
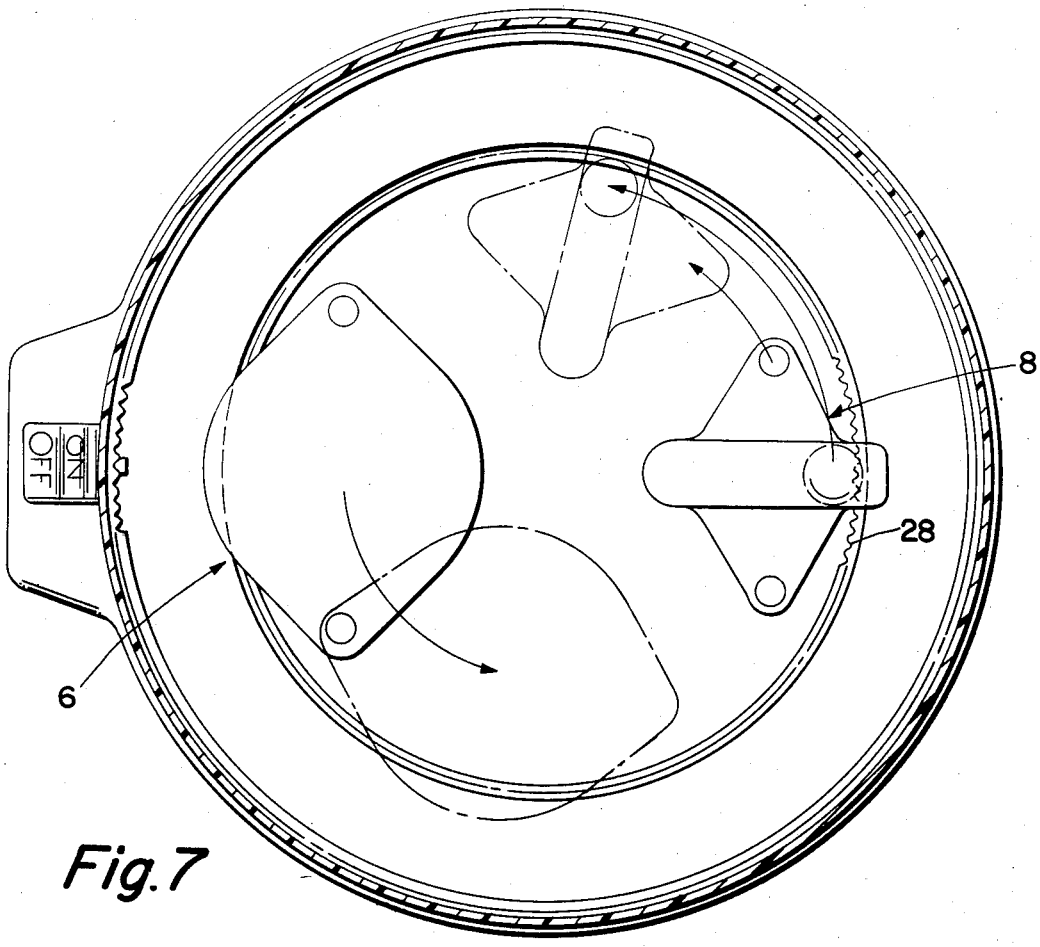
FIG. 7 is a top plan view of the assembled turntable similar to FIG. 4, but rotated in a counter-clockwise direction.

FIG. 7 illustrates the migration of the speed reduction assembly 8 around the base gear ring 28 as the platform 2 is rotated.

Figure 3:
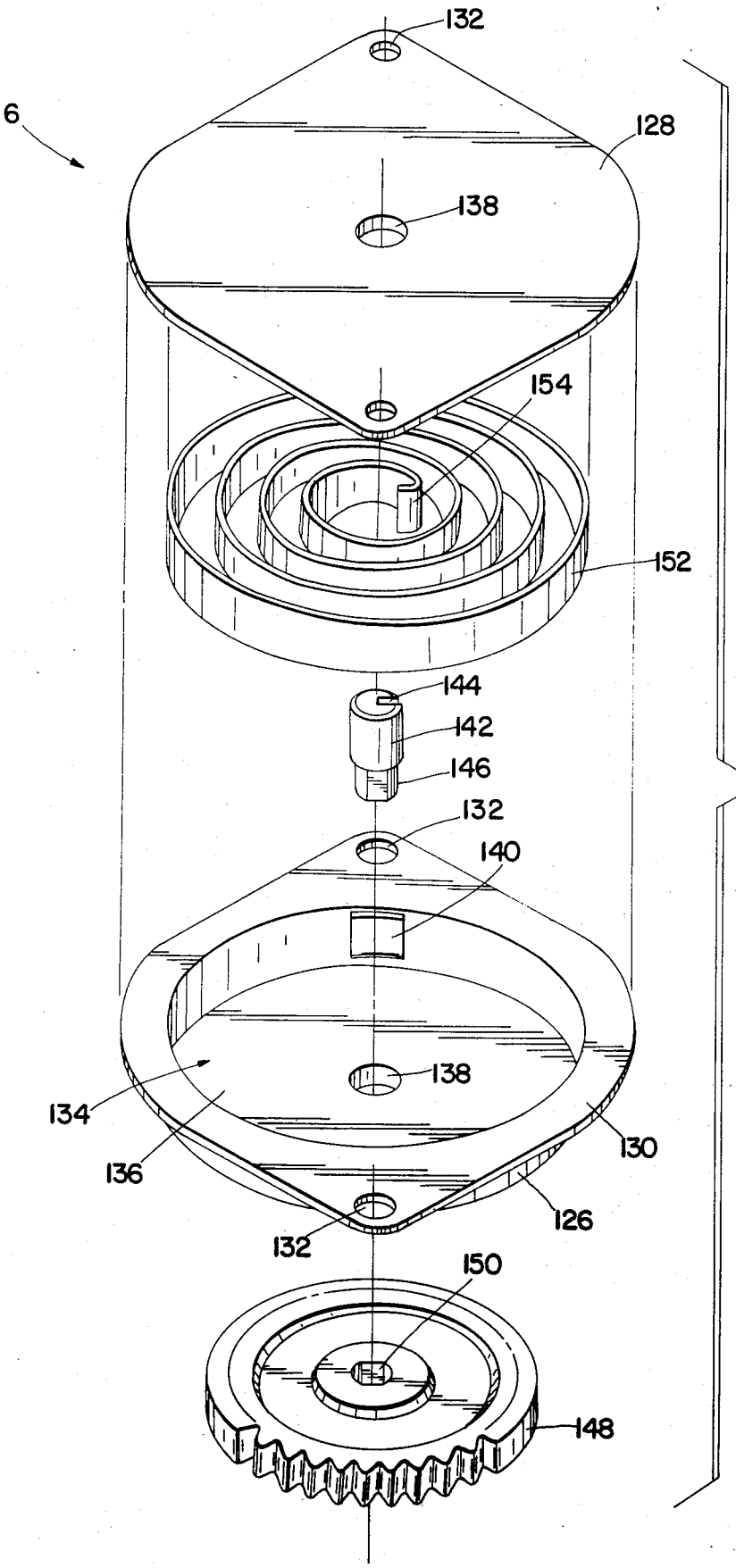
FIG. 3 is an exploded perspective view of the motor assembly.

With combined reference to FIGS. 3 and 5, the motor assembly 6 is seen to comprise a bottom housing can 126 and a top housing plate 128 formed of suitable microwave reflective material such as seamless aluminum. The bottom housing can 126 is provided with an outward turned top rim 130 having mounting apertures 132 therein for assembling the motor assembly 6 to an underside surface of the turntable platform 2. A central well 134 extends downwardly into the bottom housing can 126. An anti-friction disc 136, formed of suitable material such as polypropolene, is situated at the bottom of the center well 134 of the bottom housing can 126. Central assembly apertures 138 extend through the bottom housing can 126 and the top housing plate 128, respectively. The housing can 126 further is adapted having a slotted tab 140 in the sidewall defining central well 134.

Continuing, a stepped profile motor arbor 142 is adapted to seat vertically between the bottom housing can 126 and the top housing plate 128. The motor arbor 142 has a vertical slot 144 formed therein to extend from the top downward. A dependent shaft 146 of the arbor projects through the assembly aperture 138 of the bottom housing can 126. An external drive pinion 148, preferably having a pitch diameter of two inches or 5.08 centimeters, is provided having a central aperture 150 into which the dependent shaft segment 146 of arbor 142 is press-inserted and adhered. So assembled, the arbor 142 rotates unitarily with the drive pinion 148.

A helical spring 152 is provided for residence within the central well 134 of the bottom housing can 126. The helical spring 152 is coiled about the central arbor 142, and has an inward end 154 which is retained within the vertical slot 144 of the arbor. An outward end (not shown) of the helical spring 152 is entrapped within the vertical tab 140 in conventional fashion. So terminated, the helical spring coils into a wound condition when the arbor 142 is rotated by the drive pinion 148, and uncoils to drive the arbor in the opposite direction whenever released.

FIG. 5 illustrates the motor assembly 6 assembled to the underside surface of the turntable platform 2. The motor assembly locating post 46 on the underside surface of the turntable platform 2 projects downwardly through the mounting aperture 138 of the bottom housing can 126, and end caps (not shown) provided which fix the bottom housing can to the turntable platform upon use of a suitable adhesive. The motor assembly 6 is located off center from the center axis of the turntable platform 2 and is located such that the dependent drive pinion 148 meshes within the annular gear ring 28 of the turntable base 4. The helical spring 152 is thereby drivably coupled to the gear ring 28 through the drive pinion 148.

With reference to FIGS. 1 and 7, it will be appreciated that the motor assembly 6 and the speed reduction assembly 8 are fixedly attached to the underside surface of the turntable platform 2 in diametric opposition to one another. Both assemblies 6 and 8 are offset from the center axis of the turntable, and are in mesh with the gear ring 28 of the turntable base 4.

Figure 4:
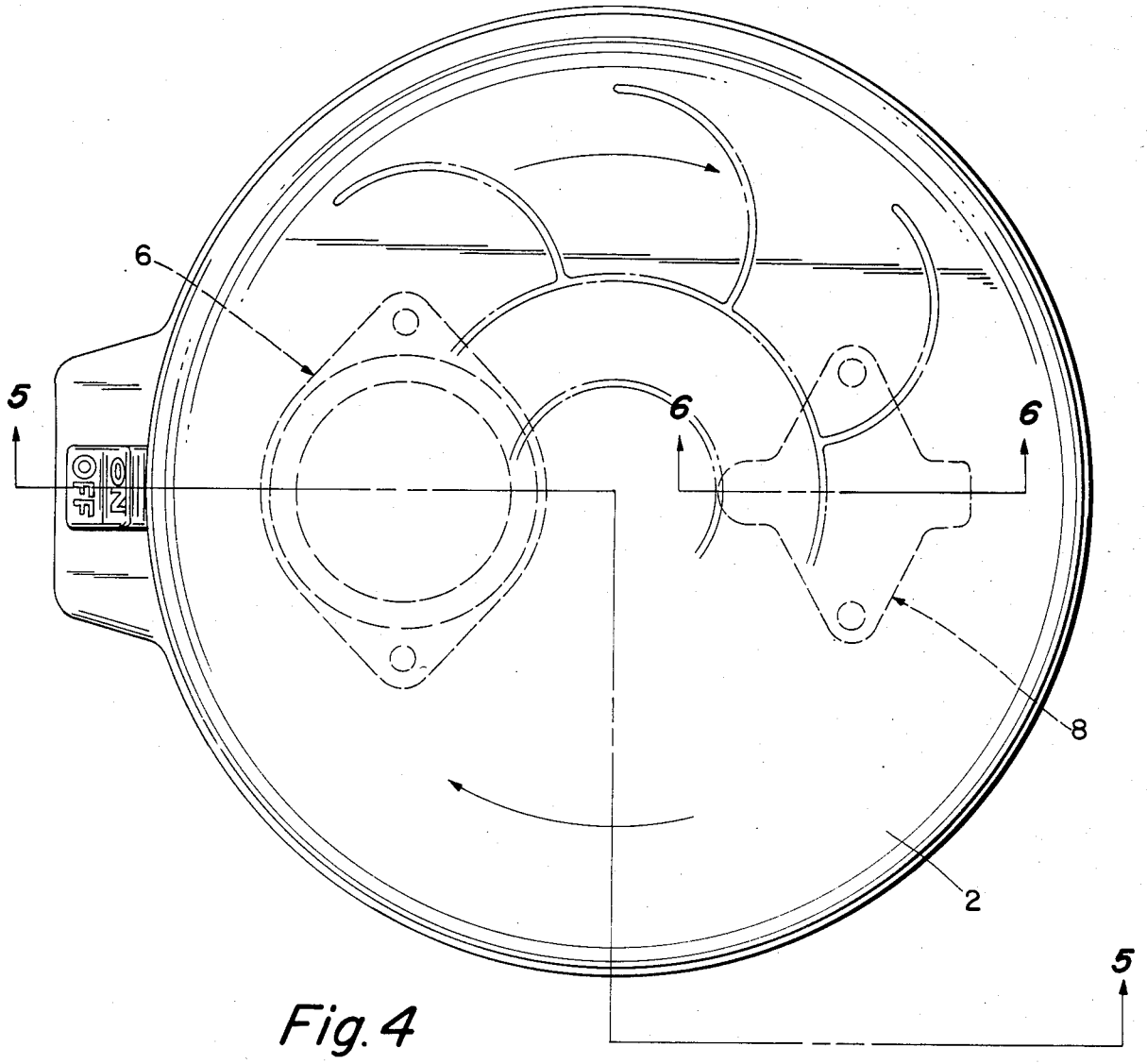
FIG. 4 is a top plan view of the turntable in the assembled condition.

Referring to FIGS. 2 and 4, a clockwise rotation of the turntable platform 2 drives the escapement gear 104 out of mesh with the star gear 110, as shaft 108 shifts within slots 90 and 90'. The gear reduction assembly 8 is thereby disengaged to permit the free rotation of the turntable platform 2 in the clockwise direction. Such rotation causes the motor assembly helical spring 152, as best viewed by FIG. 1, to coil about the motor assembly arbor 142. Thereafter, upon release of the turntable platform 2, the helical spring 152 uncoils and moves the drive pinion 148 in a counterclockwise direction.

Driving engagement between the drive pinion 148 and the base gear ring 28 causes the turntable platform 2 to rotate into counterclockwise direction. The motor assembly and the speed reducer assembly 8, being fixedly attached to the turntable platform 2, move in unison therewith. It will be appreciated that such counterclockwise rotation re-engages the gears 104 and 110 of the gear reduction assembly, which thereupon serve to regulate the speed of turntable rotation.

It will be further appreciated that the metallic housing encasing the motor assembly operates to reflect microwave energy within the oven cavity. Resultingly, migration of the motor assembly 6 about the gear ring 28 disrupts the standing wave pattern of the microwave energy within the oven cavity and serves to further diffuse the energy within the heating cavity. This creates a more uniform heating atmosphere for the cooking of food carried by the turntable platform 2. It should also be noted that location of the motor assembly 6 against the underside of the turntable platform 2 permits the motor assembly to reside totally within the perimeter of the turntable unit. This minimizes the physical size of the turntable and permits the turntable to be used in relatively small oven cavities. Finally, it should be noted that the subject turntable comprises a relatively few number of component parts. The motor assembly and the speed reduction unit can be sub-assembled independently of one another resulting in enhanced manufacturing efficiency.

While the above describes the preferred embodiment of the subject invention, the teachings are not to be so restricted. Alternative embodiments, which utilize the teachings herein set forth, are intended to be within the scope and spirit of the subject invention. For example, while the preferred embodiment teaches a fixed mounting of the motor assembly to the underside of the turntable platform 2, other mounting configurations may be used. Alternatively, the motor assembly 6 could be mounted on a separate disc which rotates independently of the turntable platform 2. Driving engagement between the motor assembly 6 and the platform 2 could then be established through a secondary gear ring integrally attached to an underside of the turntable platform. Accordingly, the motor assembly drive pinion would simultaneously engage the base gear ring 28 and the secondary turntable gear ring to establish rotational torque between platform 2 and base 4. It should further be appreciated that, assuming the above alternative mounting technique, the motor assembly 6 would still migrate and change position continuously relative to the heating cavity during its operative cycle. Thus, it would continue to serve as a secondary mode stirrer.

What is claimed is:

1. In a turntable of the type comprising a stationary base, a platform mounted to rotate about a central vertical axis of the base, and a motor assembly for moving said platform, the improvement comprising:

said motor assembly being mounted to rotate about said base central axis.

2. A turntable according to claim 1, wherein said motor assembly rotates synchronously with said turntable platform.

3. A turntable according to claim 1, wherein said motor assembly being situated offset from said central axis and below said turntable platform.

4. A turntable according to claim 1, wherein said motor assembly being fixedly mounted to an underside of said turntable platform.

5. A turntable according to claim 1, said turntable base having an annular gear ring concentric with said vertical axis, and said motor assembly including a rotary drive pinion for engageably traveling along said gear ring.

6. A turntable according to claim 5, wherein said drive pinion being disposed between said central axis and said gear ring.

7. A turntable according to claim 5, wherein said motor assembly being fixedly mounted to an underside of said turntable platform.

8. A turntable according to claim 1, wherein said turntable further comprising speed control means for regulating the speed of said turntable platform rotation.

9. A turntable according to claim 8, wherein said speed control means rotating about said base central axis.

10. A turntable according to claim 9, wherein said speed control means rotating about said base central axis diametrically opposite to said motor assembly.

11. A turntable according to claim 10, said speed control means and said motor assembly being affixed to an underside of said turntable platform.

12. A turntable according to claim 11, wherein said base having an annular gear ring concentric with said central axis and said speed control means and said motor assembly each including an output pinion for engagedly traveling along said base gear ring.

13. A turntable according to claim 1, wherein said motor assembly having an external housing composed of microwave reflective material.

14. A rotating turntable for microwave oven, or the like, comprising:

a base having a central vertical axis and a concentric gear ring extending therearound;

a platform rotatably mounted to said base to rotate about said central axis;

a motor assembly for driving said turntable platform, said motor assembly comprising an energy source and an output planetary pinion gear engagedably rotating along said base gear ring, whereby said motor assembly rotating about said base central axis.

15. A turntable according to claim 14, wherein said motor assembly pinion gear being situated between said gear ring and said central base axis.

16. A turntable according to claim 14, wherein said motor assembly having an external housing composed of microwave reflective material.

17. A turntable according to claim 14, wherein said motor assembly being affixed to an underside of said turntable platform.

18. A turntable according to claim 14, wherein said turntable further comprising speed control means for regulating the speed at which said turntable platform rotates.

19. A turntable according to claim 18, wherein said speed control means having a planatary output gear for rotatatively traveling along said base gear ring.

20. A turntable according to claim 18, wherein said speed control means and said motor assembly being affixed to an underside of said turntable platform.

21. A rotatable turntable for a microwave oven cavity, comprising: a base having a central vertical axis and a concentric gear ring extending there around;

a platform rotatably mounted to said base to rotate about said central axis;

motor assembly means for driving said turntable platform, said motor assembly means comprising an external housing composed of microwave reflective material adapted to move relative to said base during rotation of said microwave platform, whereby disrupting standing microwave patterns within said oven cavity.

22. A turntable according to claim 21, wherein said motor assembly housing moving in unison with said turntable platform.

23. A turntable according to claim 21, wherein said motor assembly being situated beneath said turntable platform offset from said central axis of said base, and said motor assembly having outward directed drive pinion means for engaging said turntable base gear ring.

24. In a transportable detached turntable for use in a microwave oven of the turntable type comprising a stationery base composed of dielectric material, a platform composed of dielectric material mounted to rotate about a central vertical axis of the base, and a motor assembly for moving said platform, the improvement comprising:

said turntable having microwave reflective means offset and eccentrically spaced a distance from said central vertical axis and mounted to move relative to the stationery base of said turntable during operation subject to exposure to said microwave oven radiation, whereby operatively disrupting the standing pattern of said microwave radiation within said microwave oven.

25. A turntable according to claim 24, wherein said microwave reflective means moving in a circular path about said central vertical axis of the base.

26. A turntable according to claim 25, wherein said microwave reflective means comprising a casing for said motor assembly.

27. A turntable according to claim 26, wherein said motor assembly unitarily rotating about said base central axis with said casing.

28. A turntable according to claim 27, wherein said casing being affixed to an underside of said platform.

* * * * *